United States Patent [19]

Forlani

[11] 4,438,722

[45] Mar. 27, 1984

[54] DEVELOPMENT UNIT FOR ELECTROPHOTOCOPIERS

[75] Inventor: Riccardo Forlani, Turin, Italy

[73] Assignee: Ing. C. Olivetti & C., S.p.A., Ivrea, Italy

[21] Appl. No.: 513,815

[22] Filed: Jul. 15, 1983

[30] Foreign Application Priority Data

Aug. 20, 1983 [IT] Italy ..... 68026 A/82

[51] Int. Cl.[3] ..... G03G 15/09

[52] U.S. Cl. ..... 118/657; 355/3 DD

[58] Field of Search ..... 118/657, 658

[56] References Cited

U.S. PATENT DOCUMENTS 4,385,829 5/1983 Nakahata et al. ..... 355/3 DD

*Primary Examiner*—Bernard D. Pianalto

*Attorney, Agent, or Firm*—W. R. Hulbert

[57] ABSTRACT

A magnetic brush (10) comprises a sleeve (16) of non-magnetic material which rotates about magnets (14) fixed on a shaft (12) which rotates in the opposite direction to the sleeve. A toner container (20) adjacent to the sleeve feeds the toner (T) on to the outer surface of the sleeve through a slit (36) which extends over the entire length of the sleeve. In order to prevent the formation of lumps of toner at the feed slit and break up any lumps already in the container, a portion (32) of the base wall of the toner container is of arcuate shape and is spaced from the sleeve by a distance equal to the thickness of the toner layer (52) on the sleeve. The arcuate wall defines the toner feed slit (36) in cooperation with a side wall (60) of the container. A baffle (26) divides the container into a main chamber (42) and secondary chamber (46) which communicate with each other by way of a narrow passage between the baffle and the arcuate wall (32). The magnetic field of the brush magnets urges the toner along the arcuate wall in order to fill the secondary chamber to a certain level, from which it emerges from the feed slit. Any lumps of toner or foreign particles are blocked by the dividing baffle. Lumps of toner are agitated by the variations in the magnetic field, so that they gradually disintegrate to allow recovery of the toner.

8 Claims, 3 Drawing Figures

DEVELOPMENT UNIT FOR ELECTROPHOTOCOPIERS

BACKGROUND OF THE INVENTION

This invention relates to a development unit for electrophotocopiers, comprising a magnetic brush in which a rotatable sleeve of non-magnetic material encloses a plurality of magnets fixed on to a rotatable shaft, and a toner container situated adjacent to the sleeve in order to feed the magnetic brush through a slit with the toner free from any lumps or foreign bodies.

Various types of magnetic brush development units are known in which the toner, contained in a container adjacent to the magnetic brush, is fed to the magnetic brush after being freed of any lumps of toner by mechanical agitation and crushing devices.

In one such development unit, the agitation devices are formed from a magnetic element rotatable in the toner container in proximity to the feed slit. By virtue of the rotation of the magnetic element, the toner is kept in continuous agitation so that the possibility of lump formation is reduced, and any previously existing lumps are broken up.

In another type of development unit, the agitation device is constituted by a rigid bar located on the container, and moved in a reciprocating manner by a rotating cam rigid with the shaft of the magnetic brush in order to agitate the toner and prevent lump formation.

All these devices are mechanically complicated and easily subject to faults. Moreover, they do not prevent the formation of lumps in the feed slit, which form by accumulation and compacting of the toner, especially during long periods of inactivity of the copier.

SUMMARY OF THE INVENTION

The object of the invention is to provide a development unit of simple construction which can prevent the formation of toner lumps and to break up any lumps already existing at the slit for feeding the toner to the magnetic brush.

A further aspect of the invention is to separate and retain any foreign bodies contained in the mass of toner inside the container. The development unit according to the present invention is characterised in that the container comprises an arcuate base wall embracing a portion of the sleeve of the magnetic brush and bounded by an edge which is adjacent to and spaced from a side wall of the container so as to define the toner feed slit, wherein the toner is urged by the action of the magnets along the arcuate wall toward the slit, and the lumps are broken up.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

Figure 1:
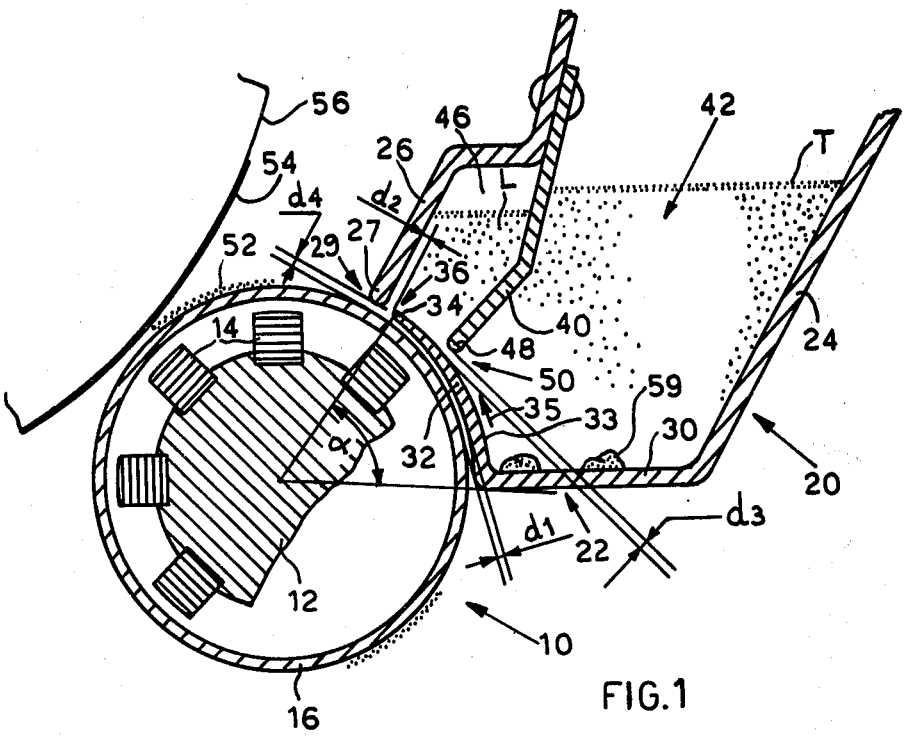
FIG. 1 is a section through a development unit embodying the invention.

With reference to FIG. 1, a magnetic brush 10 is formed from a rotatable shaft 12 which supports on its periphery a plurality of permanent magnets 14. The magnets 14 are formed from parallelepiped bars fixed to the shaft 12 and extending parallel to the axis of rotation of the shaft 12.

A cylindrical sleeve 16 of non-magnetic material, coaxial to the shaft 12, rotates round the magnets 14 in the opposite direction to the rotation of the shaft 12. In the illustrated embodiment, the shaft 12 rotates in a clockwise direction whereas the sleeve 16 rotates in an anticlockwise direction.

A container 20 for the toner T is disposed in proximity to the magnetic brush 10 and comprises a base wall 22 and two side walls 24 and 26. The base wall 22 is formed from a flat portion 30 which is substantially but not necessarily horizontal, and an arcuate portion 32 of non-magnetic material which embraces the sleeve 16 at a distance d1 therefrom of about 1.2 mm. The portion 32 is arcuate in the form of a circular arc concentric with the axis of rotation of the sleeve 16 and extending through an arc of width $\alpha$ between 30° and 80°, and preferably between 45° and 65°.

The arcuate portion 32 has a thickness S tapering from about 1.5 mm, where it connects to the portion 30, to about 1 mm at an edge 34 which borders the portion 32. The edge 34 faces the side wall 26 of the container 20 at a distance d2 therefrom of between 1.4 and 2 mm, and defines a slit 36 for feeding the toner T to the outer surface of the sleeve 16. Inside the container 20 into a first chamber 42 lying between the baffle 40, the arcuate portion 32, the base and the side wall 24, and a second chamber 46 lying between the arcuate portion 32 and the wall 26. The dividing baffle 40 terminates in a lower edge 48 which faces the arcuate portion 32 at a distance d3 therefrom of about 1.6 mm to define a slot 50 for the passage of the toner T from the chamber 42 to the chamber 46.

During operation, the toner T which fills the chamber 42 of the container 20 flows through the slot 50 into the chamber 46, urged along the arcuate portion 32 by the pulsating action of the magnetic field of the magnets 14. In this respect, the successive passage of magnets 14 under the arcuate portion 32 generates a variable magnetic field on the toner particles lying on the inner surface 33 of the arcuate portion 32. This magnetic field generates pulsating forces applied to the individual particles, which keep them agitated, and urge them along the surface 33 in the direction of the arrow 35 towards the slot 50. The pulsating forces also act on the toner particles located inside the slot 50 and at the slit 36, so that the formation of lumps of toner in these lower passages is prevented. Moreover, any lumps of toner such as 59 (FIG. 1) which previously existed in the container 20 are subjected by the magnetic field variation to vibrations which breaks them up, so that the toner which formed them is recovered in the form of powder.

Simultaneously, part of the toner which has entered the chamber 46 flows through the slit 36 on the outer surface of the sleeve 16 to form a uniform layer 52 of height equal to the distance d1 between the arcuate portion 32 and the sleeve 16. The quantity of toner which flows from the chamber 46 on to the sleeve 16 is regulated both by the width d2 of the slot 36 and by the distance d4 of an edge 27 of the lateral wall 26 from the sleeve 16.

After the toner layer 52 has completely formed, the toner entering the chamber 46 through the slot 50 fills the chamber 46 to a level L (FIG. 1) representing equilibrium between the pressure of toner in the chamber 46 and the thrust of the toner arriving from the chamber 42.

During the copying cycles, part of the toner of the layer 52 is transferred on to a photoconductor element, indicated diagrammatically at 54, disposed on a drum 56, in order to make the latent image previously formed on the photoconductor 54 visible. The layer 52 is continuously made up with new toner flowing from the chamber 46 through the slit 36, and the level L is maintained at its equilibrium value by further toner thrust into the chamber 46. Any foreign particles accidentally present in the toner in the container 20 are arrested by the dividing baffle 40.

Figure 2:
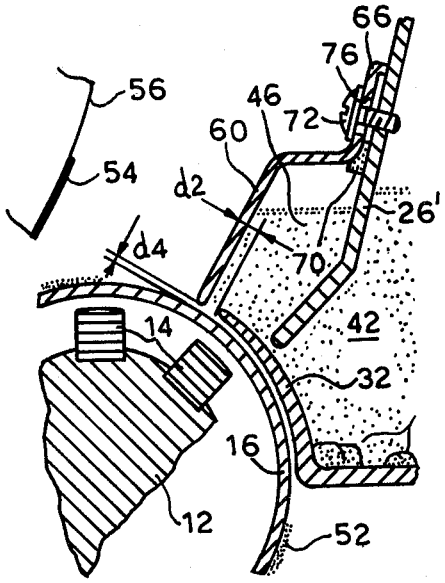
FIG. 2 is a partial section through a first modification of the development unit of FIG. 1.

In order to accurately adjust the width d2 of the slit 36 (FIG. 1) and the distance d4 between the edge 27 of the side wall 26 and the sleeve 16, the wall 26 may be replaced by a thin closure element 60 (FIG. 2) bent into Z shape and connected to the wall 26' which now replaces the baffle 40 of FIG. 1. The element 60 terminates in a lower edge 62 adjacent to the sleeve 16 at a distance d4 therefrom, and a flat part 64 of the element 60 is situated at a distance d2 from the edge 34 of the arcuate portion 32. The element 60 is kept at a convenient distances from the wall 26' by means of an edge 66 bent against the wall 26' and a spacer block 70 of yieldable material disposed between the wall 26' and the element 60. Screws 72 connect the element 60 to the wall 26' in such a manner that by tightening the screws 72 to a greater or less extent the element 60 rotates about the edge 66 to likewise squeeze the block 70 to a greater or lesser extent. In this manner the distance d2 can be adjusted accurately. To adjust the distance d4, a slot 76 is provided in the element 60, through which the screws 72 pass, so that the element 60 can be slid along the wall 26'.

Figure 3:
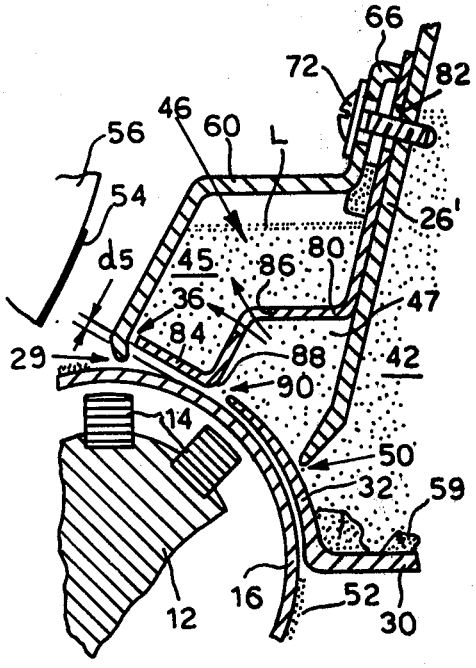
FIG. 3 is a partial section through a second modification of the unit of FIG. 1.

FIG. 3 shows a second modification of the development unit according to the invention, by means of which it is possible to separate and remove any foreign bodies which have accidentally fallen on to the magnetic brush and have been retained in the toner layer 52. A separation diaphragm 80 is disposed in the chamber 46 to divide it into an upper part 45 and a lower part 47. The diaphragm 80 is substantially of L shape and comprises a short arm 84 and a long arm 85 connected to the wall 26'. The diaphragm 80 extends over the entire length of the chamber 46 in the direction perpendicular to FIG. 3.

The diaphragm 80 is connected to the wall 26' by screws 72, which traverse it through slots 82 in order to allow adjustment of the distance d5 between the sleeve 16 and the arm 84, which is positioned tangentially to the sleeve 16. The purpose of the arm 84 is to extend the arcuate portion 32 into the upper chamber 45. The diaphragm 80 is provided in its central region with a series of apertures 86 to allow passage of the toner from the lower part 47 to the upper part 45 of the chamber 46.

The distance d5 is adjusted to about one half the height of the toner layer on the sleeve 16, so that, during operation, part of the toner returning on the sleeve to the container 20 becomes scraped by an edge 88 of the arm 84, and is made to flow through the passage 90 into the chamber 47. From here, the toner which fills the chamber 47 passes through the apertures 86 into the chamber 45, from which it leaves through the slits 36 and 29 in order to completely reconstitute the toner layer on the sleeve 16.

In this manner, any foreign body present in the toner on the sleeve and having a size exceeding the value of d5 is retained by the edge 88 of the diaphragm 80 and fed into the chamber 47 by the flow of toner through the passage 90. The foreign bodies which have entered the chamber 47 tend to migrate by gravity to the lower part of the chamber, and can transfer into the upper chamber 45 only with difficulty, because the flow of toner through the apertures 86 is very slow.

The preceding description describes a unit for developing latent images by means of toner powder 46, which is of very simple construction and can ensure high copy quality, free from the drawbacks induced by the formation of toner lumps in the feed slit. Moreover, any preexisting lumps are disintegrated in a very simple manner without use of mechanical means, but merely by the action of the magnetic field variations produced by the rotation of the magnets 14.

I claim:

1. A development unit for electrophotocopiers, comprising a magnetic brush (10) in which a rotatable sleeve (16) of non-magnetic material encloses a plurality of magnets (14) fixed on to a rotatable shaft (12), and a toner container (20) situated adjacent to the sleeve in order to feed the magnetic brush through a slit (36) with the toner freed from any lumps or foreign bodies, characterised in that the container (20) comprises an arcuate base wall (32) embracing a portion of the sleeve (16) and bounded by an edge (34) adjacent to and spaced from a side wall (27) of the container so as to define the toner feed slit (36) wherein the action of the variable magnetic field produced by the rotating magnets (14) urges the toner (T) along the arcuate base wall (32) towards the slit and breaks up lumps in the container.

2. A development unit as claimed in claim 1, characterised in that a baffle (40) bounded by a straight edge (48) divides the inner volume of the container (20) into first and second chambers (42 and 46) which communicate with each other through a gap (50) between the arcuate base wall (32) and the edge (48) of the baffle, in order to allow passage of the toner (T) while retaining unbroken lumps and any foreign bodies in the first of the two chambers (42).

3. A development unit as claimed in claim 2, characterised in that the side wall (26', 60) comprises a removable closure element (60) connected to a fixed part (26') of the side wall and enclosing the second chamber (46), the said element being adjustable on the fixed part so as to adjust the width (d2) of the feed slit in order to control the flow of the toner (T) between the container (20) and the sleeve (16).

4. A development unit as claimed in claim 3, characterised in that the closure elements (60) has an edge adjacent to the sleeve (16) and is slidable on the fixed wall part (26) so as to adjust the gap (d4) between this edge and the sleeve.

5. A development unit as claimed in claim 2, characterised in that the second chamber (46) is divided by a diaphragm (80) into an upper part (45) for communication between the lower part (47), the diaphragm comprising apertures (86) for communication between the lower and upper parts of the second chamber, so that the toner (T) flows from the lower part into the upper part of the second chamber.

6. A development unit as claimed in claim 5, characterised in that the diaphragm (80) comprises an end wall (84) facing towards and positioned tangentially to the sleeve (16), the end wall being disposed as a continuation of the arcuate base wall (32) towards the closure element (60).

7. A development unit as claimed in claim 6, characterised in that the end wall (84) has a first edge (88) facing the sleeve (16) at a distance (d5) therefrom which is less than the distance (d1) between the arcuate base wall (32) and the sleeve, in order to scrape a layer of toner on the sleeve which contains possible foreign bodies.

8. A development unit as claimed in claim 7, characterised in that the end wall (84) defines the feed slit (36) between a second edge distant from the said first edge (88) and the closure element (60), and defines a passage (90) between the said first edge and the adjacent part of the arcuate wall (32), so that the toner (T) contained in the upper part (45) of the second chamber is transferred on to the sleeve (16) through the feed slit (36), while foreign bodies are conveyed by the said first edge (88) into the lower part (47) of the second chamber, through the said passage.

* * * * *